US009335115B2

(12) United States Patent
Bednar et al.

(10) Patent No.: US 9,335,115 B2
(45) **Date of Patent: *May 10, 2016**

(54) INTEGRATED COCKING DEVICE

(71) Applicant: Hunter's Manufacturing Company, Inc., Suffield, OH (US)

(72) Inventors: Richard L. Bednar, Munroe Falls, OH (US); Michael J. Shaffer, Mogadore, OH (US); Jacob A. Hout, Akron, OH (US)

(73) Assignee: Hunter's Manufacturing Co., Inc., Suffield, OH (US)

( * ) Notice: Subject to any disclaimer, the term of this patent is extended or adjusted under 35 U.S.C. 154(b) by 197 days.

This patent is subject to a terminal disclaimer.

(21) Appl. No.: 13/926,274

(22) Filed: Jul. 31, 2013

(65) Prior Publication Data

US 2013/0298890 A1 Nov. 14, 2013

Related U.S. Application Data

(63) Continuation of application No. 13/028,262, filed on Feb. 16, 2011, now Pat. No. 8,499,753.

(51) Int. Cl.

| | |
|---|---|
| ***F41B 5/18*** | (2006.01) |
| ***F41B 5/12*** | (2006.01) |
| ***F41B 5/14*** | (2006.01) |

(52) U.S. Cl.

CPC . *F41B 5/12* (2013.01); *F41B 5/123* (2013.01); *F41B 5/1469* (2013.01); *Y10T 29/49826* (2015.01)

(58) Field of Classification Search

CPC ..... F41B 5/00; F41B 5/12; F41B 5/123; F41B 5/1469; A01K 27/004; Y10T 29/49826

See application file for complete search history.

(56) References Cited

U.S. PATENT DOCUMENTS

| | | | | |
|---|---|---|---|---|
| 1,051,914 | A * | 2/1913 | Prochnow | 42/85 |
| 2,092,361 | A * | 9/1937 | Shirn | 124/25 |
| 3,043,287 | A | 7/1962 | Nelson | |
| 3,561,419 | A | 2/1971 | Cucuzza, Sr. | |
| 3,670,711 | A | 6/1972 | Firestone | |
| 3,739,765 | A | 6/1973 | Moore | |
| 4,192,281 | A | 3/1980 | King | |
| 4,246,883 | A | 1/1981 | Ash | |
| 4,593,675 | A | 6/1986 | Waiser | |
| 4,603,676 | A | 8/1986 | Luoma | |
| 4,649,892 | A | 3/1987 | Bozek | |
| 4,662,345 | A | 5/1987 | Stephens | |
| 4,665,885 | A | 5/1987 | Glomski et al. | |
| 4,719,897 | A | 1/1988 | Gaudreau | |
| 4,721,092 | A | 1/1988 | Waiser | |
| 4,942,861 | A | 7/1990 | Bozek | |
| 5,115,795 | A | 5/1992 | Farris | |
| 5,205,267 | A | 4/1993 | Burdick | |

(Continued)

OTHER PUBLICATIONS

A Guide to the Crossbow, by W.F. Paterson, published by the Society of Archer-Antiquaries, 1990.

(Continued)

*Primary Examiner* — John E Simms, Jr.

(74) *Attorney, Agent, or Firm* — Emerson Thomson Bennett

(57) ABSTRACT

A cocking device for drawing the bowstring of a crossbow that can be selectively installed on an existing crossbow. The cocking device comprises a shape designed to prevent the cocking device from being improperly installed.

21 Claims, 6 Drawing Sheets

(56) References Cited

U.S. PATENT DOCUMENTS

| | | | | | |
|---|---|---|---|---|---|
| 5,215,069 | A | | 6/1993 | Liu | |
| 5,220,906 | A | | 6/1993 | Choma | |
| 5,243,956 | A | | 9/1993 | Luehring | |
| 5,433,186 | A | | 7/1995 | Corwin | |
| 5,437,260 | A | | 8/1995 | King | |
| 5,445,139 | A | | 8/1995 | Bybee | |
| 5,513,785 | A | * | 5/1996 | Campagna, Jr. | 224/162 |
| 5,553,596 | A | | 9/1996 | Bednar | |
| 5,598,829 | A | | 2/1997 | Bednar | |
| 5,649,520 | A | | 7/1997 | Bednar | |
| 5,678,528 | A | | 10/1997 | Hadley | |
| 5,701,981 | A | * | 12/1997 | Marshall et al. | 191/12.4 |
| 5,746,192 | A | * | 5/1998 | Gissel | 124/1 |
| 5,987,724 | A | | 11/1999 | Kleman | |
| 6,095,128 | A | | 8/2000 | Bednar | |
| 6,286,496 | B1 | | 9/2001 | Bednar | |
| 6,874,491 | B2 | | 4/2005 | Bednar | |
| 6,913,007 | B2 | | 7/2005 | Bednar | |
| 7,100,590 | B2 | | 9/2006 | Chang | |
| 7,624,725 | B1 | | 12/2009 | Choma | |
| 7,784,453 | B1 | | 8/2010 | Yehle | |
| 8,443,790 | B2 | | 5/2013 | Pestrue | |
| 8,499,753 | B2 | | 8/2013 | Bednar | |
| 2005/0022799 | A1 | * | 2/2005 | Bednar | 124/25 |
| 2006/0086346 | A1 | * | 4/2006 | Middleton | 124/25 |
| 2010/0170488 | A1 | | 7/2010 | Rasor et al. | |

OTHER PUBLICATIONS

European Crossbows, A Survey by Josef Alm, copyrighted by the Trustees of the Royal Armouries and the Arms and Armour Society, 1994.

The Book of the Crossbow, by Ralph Payne-Gallwey, published by Dover Publications, Inc. of New York, 1995.

* cited by examiner

INTEGRATED COCKING DEVICE

I. BACKGROUND

A. Field of Invention

This invention pertains to the art of methods and apparatuses of cocking devices for crossbows and even more particularly, to the art of methods and apparatuses relating to installing an integrated cocking device for drawing the bowstring of a crossbow.

B. Description of the Related Art

It is known in the art to draw back the bowstring for a crossbow device. The drawing of the bowstring causes potential energy to be stored in the limbs of the crossbow. A bolt or arrow can then be placed on the upper surface of the barrel of the crossbow such that the release of the bowstring causes the potential energy stored in the limbs to be transferred to the bolt or arrow to propel it from the crossbow. To accurately target intended game, a substantial amount of energy must be transferred from the limbs of the crossbow to the arrow or bolt being propelled therefrom. As a result, it may be difficult for an associated user to exert the force necessary draw back the bowstring, especially if the associated user is smaller in stature or has physical limitations that impede his or her ability to draw back the bowstring.

II. SUMMARY

According to one embodiment of the invention, a crossbow may comprise a main beam, a handgrip, a trigger mechanism, a bow assembly, and a cocking device. The main beam may comprise a stock member having a device aperture formed through the stock member and defined by a perimeter; and, a barrel member. The barrel member may be coupled to the stock member and may comprise an upper surface having a channel formed in the upper surface that receives at least a portion of an arrow placed on the upper surface to be fired from the crossbow. The handgrip may be mounted to the main beam. The trigger mechanism may be operatively connected to the main beam and may be positioned proximate to the hand grip. The bow assembly may be operatively connected to a first end of the main beam. The bow assembly may comprise a bow portion comprising a first bow limb and a second bow limb; a riser, wherein the riser is connected to the first end of the main beam and operatively connects the first and second bow limbs to the main beam; and a bow string, wherein the bow string extends between the distal ends of the first and second bow limbs. The bowstring can be drawn rearward and retained by the trigger mechanism and selectively released to propel the arrow from the crossbow. The cocking device can be selectively inserted through the device aperture to install the cocking device on the crossbow. The cocking device may comprise a first base plate; a second base plate operatively connected to the first base plate; a shaft member, wherein the shaft member is rotatably received through the first and second base plates; a first side plate connected to a first end of the shaft member; a second side plate connected to a second end of the shaft member, wherein the rotation of the shaft member causes a corresponding rotation of the first and second side plates; a first rope member operatively connected to the shaft member between the first base plate and the first side plate; a second rope member operatively connected to the shaft member between the second base plate and the second side plate, wherein the rotation of the shaft member causes a change in an effective length of the first and second rope members; a first hook member operatively connected to the first rope member; a second hook member operatively connected to the second rope member, wherein the first and second hook members can be selectively engaged with the bowstring; a first handle operatively connected to the first rope member; and, a second handle operatively connected to the second rope member. The first and second hook members can be selectively engaged with the bowstring and the first and second handles can be grasped by an associated user to draw the bowstring to cause the bowstring to be selectively retained by the trigger mechanism. The device aperture may comprise a shape that limits the manner in which the cocking device can be inserted through the device aperture to at least partially ensure that the cocking device is properly installed on the crossbow.

According to one embodiment of the invention, a method for installing an integrated cocking device on a crossbow comprising the steps of: (a) providing a crossbow comprising a main beam comprising a stock member having a device aperture formed through the stock member and defined by a perimeter; and, a barrel member; a trigger mechanism operatively connected to the main beam and positioned proximate to a handgrip mounted to the main beam; a bow assembly operatively connected to a first end of the main beam, wherein the bow assembly comprises: a first bow limb and a second bow limb; a bow string, wherein the bow string extends between the distal ends of the first and second bow limbs, wherein the bowstring can be drawn rearward and retained by the trigger mechanism and selectively released to propel the arrow from the crossbow; (b) inserting a first handle, a first hook member, and a first rope member of a cocking device through the device aperture; (c) orienting the cocking device in a first orientation; (d) inserting a first base plate of the cocking device through the device aperture to cause a second base plate of the cocking device to abut at least a portion of the stock member such that the first and second base plates are positioned on opposing sides of the stock member, wherein the device aperture comprises a shape that prevents the first base plate from passing through the device aperture unless the cocking device is oriented in the first orientation; (e) aligning a first threaded aperture with a first attachment aperture; and, (f) attaching the cocking device to the stock member.

According to one embodiment of the invention, a method may comprise the steps of: (a) providing a cocking device comprising a first base plate; a second base plate operatively connected to the first base plate; a shaft member, wherein the shaft member is rotatably received through the first and second base plates; a first rope member operatively connected to the shaft member between the first base plate and a first end of the shaft member; a second rope member operatively connected to the shaft member between the second base plate and a second end of the shaft member, wherein the rotation of the shaft member causes a change in an effective length of the first and second rope members; a first hook member operatively connected to the first rope member; a second hook member operatively connected to the second rope member; a first handle operatively connected to the first rope member; a second handle operatively connected to the second rope member; (b) passing the first handle and the first hook member through a device aperture formed in a stock member of a crossbow; (c) passing the first base plate through the device aperture to cause the second base plate to abut the stock member wherein the device aperture comprises a shape that prevents the passing of the first base plate through the device aperture unless the first base plate is properly oriented and substantially prevents the second base plate from passing through the device aperture to at least partially ensure the proper installation of the cocking device on the stock member; and, (d) attaching the cocking device to the stock member.

Still other benefits and advantages of the invention will become apparent to those skilled in the art to which it pertains upon a reading and understanding of the following detailed specification.

III. BRIEF DESCRIPTION OF THE DRAWINGS

The invention may take physical form in certain parts and arrangement of parts, a preferred embodiment of which will be described in detail in this specification and illustrated in the accompanying drawings which form a part hereof and wherein.

IV. DETAILED DESCRIPTION

Figure 1:
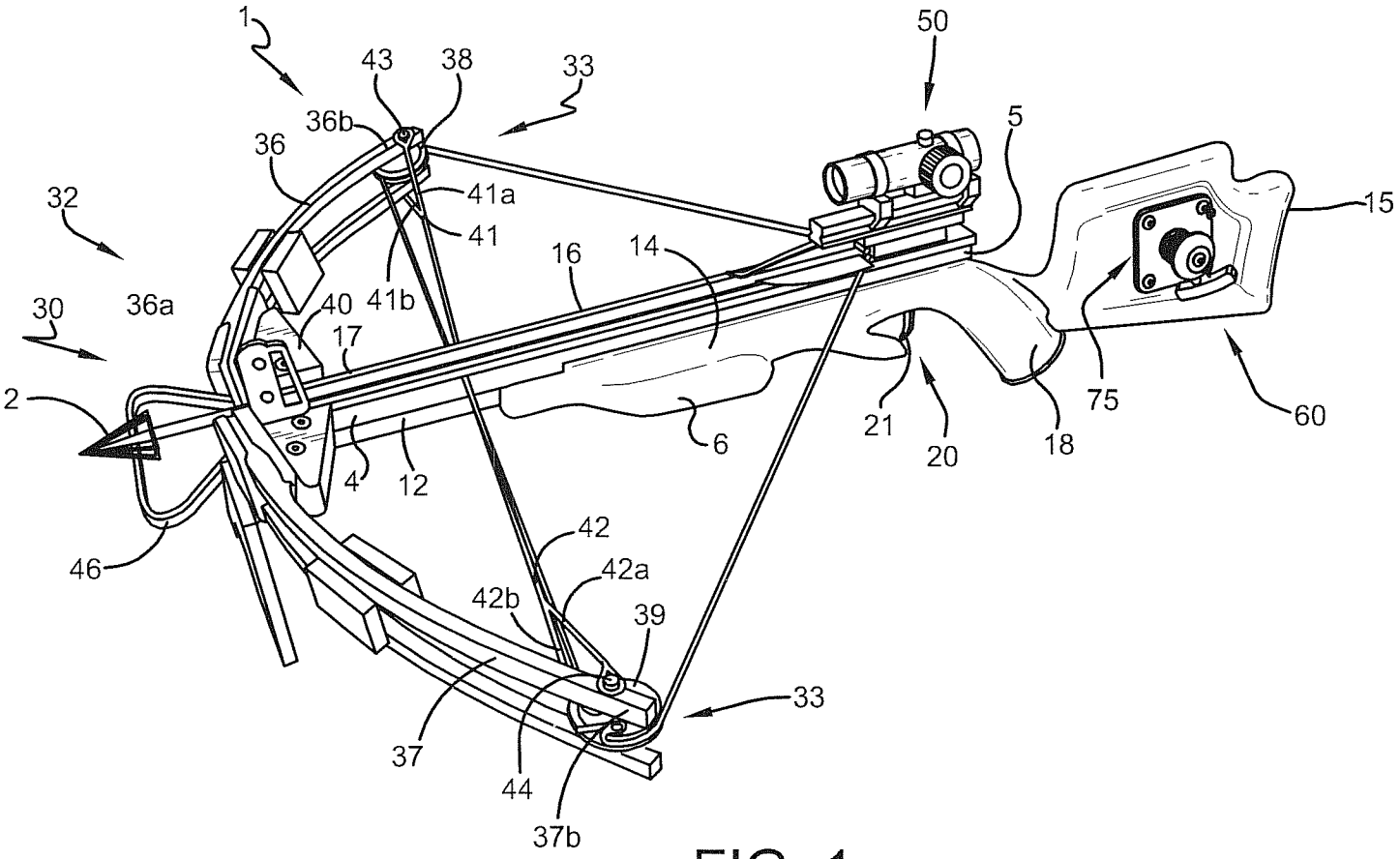
FIG. 1 shows a perspective view of a crossbow comprising a stock member having an integrated cocking device installed therein according to one embodiment of the invention.

Referring now to the drawings wherein the showings are for purposes of illustrating embodiments of the invention only and not for purposes of limiting the same, FIG. 1 shows a crossbow, depicted generally at 1, that is adapted for the installation of an integrated cocking device 60. While the crossbow 1 shown is a compound bow, it should be understood that this invention will work well with any type of crossbow chosen with sound judgment by a person of ordinary skill in the art. The crossbow 1 may comprise a main beam 12, a trigger mechanism 20, and a bow assembly 30 as further described below. Optionally, many other crossbow components may be used with a crossbow using this invention. The crossbow 1 shown, for example, includes a foot stirrup 46 mounted to one end of the main beam 12, a scope 50 that is supported on the trigger mechanism 20, and one or more swivel studs, not shown, for attaching a sling or similar device for transporting the crossbow 1. As the operation of these components is well known to those of skill in the art, no further details will be provided.

With reference now to FIG. 1, the main beam 12 may comprise a stock member 14 and a barrel member 16. The stock member 14 may comprise a member that is placed against a shoulder of a user when firing an arrow from the crossbow 1. In one embodiment, the stock member 14 may comprise a butt portion 15 that may be juxtaposed to or placed against the shoulder of the user when firing a bolt or arrow 2 from the crossbow 1. The barrel member 16 may be coupled to the stock member 14 and may comprise an elongated member that extends generally parallel with a desired flight pattern of the arrow 2 to be propelled or fired from the crossbow 1. The barrel member 16 may comprise an upper surface 17 having a channel, not shown, formed therein. The channel, not shown, may receive a member of the fletching of the arrow 2 and may act as a guide to assist in directing the arrow 2 from the crossbow 1. In one embodiment, the stock member 14 and the barrel member 16 may comprise separate components that are operatively connected to form the main beam 12. In another embodiment, the stock member 14 and the barrel member 16 may comprise an integral component thereby forming the main beam 12. A handgrip 18 may be mounted to the main beam 12 in any conventional manner chosen with sound judgment by a person of ordinary skill in the art. In one embodiment, the handgrip 18 may be fashioned in the stock member 14 wherein the trigger mechanism 20 is installed proximate to the handgrip 18; generally toward a second end 5 of the main beam 12. This allows the associated operator to securely grasp the crossbow 1 with a first hand during operation of the crossbow 1. The other hand of the associated operator may grasp a grip guard 6 attached to the barrel member 16 toward a first end 4 of the main beam 12. This allows the operator to firmly hold the crossbow 1 during operation and discharge.

With continued reference to FIG. 1, the bow assembly 30 may be operatively connected to the first end 4 of the main beam 12. The bow assembly 30 may comprise a bow portion 32, a cam assembly 33, and a bowstring 34. The bow portion 32 may include a first limb 36 and a second limb 37. The first and second limbs 36, 37 may each comprise a first end 36*a*, 37*a* and a second end 36*b*, 37*b* respectively. The first ends 36*a*, 37*a* may be operatively connected to the end of the main beam 12 such that the first and second limbs 36, 37 extend transversely thereto in opposite directions generally away from the main beam 12. The first and second limbs 36, 37 may comprise a single member or two or more separate members each operatively connected to the crossbow 1. In one embodiment, the bow assembly 30 may include a riser or block 40 for operatively connecting the first and second limbs 36, 37 to the crossbow 1. The riser 40 may comprise a pair of limb pockets that receive the first ends 36*a*, 37*a* of the first and second limbs 36, 37. The first and second limbs 36, 37 may be operatively connected to the riser 40 utilizing any method chosen with sound judgment by a person of ordinary skill in the art.

With continued reference to FIG. 1, the cam assembly 33 may comprise a first cam 38, a second cam 39, a first barrel cable 41, and a second barrel cable 42. The first and second cams 38, 39 may be operatively connected to the second ends 36*b*, 37*b* of the first and second limbs 36, 37, respectively. In one embodiment, the first cam 38 may be operatively connected to the second end 36*b* to rotate about an axle 43. The second cam 39 may be operatively connected to the second end 37*b* to rotate about an axle 44. The first and second cams 38, 39 may receive the bowstring 34 and may rotate about axles 43, 44 in a first direction as the bowstring 34 is drawn rearward and in a second direction, opposite to the first direction as the bowstring 34 is released. In one embodiment, the first and second cam assemblies 38, 39 may comprise oblong or eccentric shaped pulley mechanisms over which the bowstring 34 travels as it is drawn and released. Once the bowstring 34 is drawn past a predetermined point rearward towards the butt portion 15 of the stock member 14, the first and second cams 38, 39 may serve to minimize the force that must be imparted on the bowstring 34 to maintain the bowstring 34 in this drawn position. Similarly, as the bowstring 34 is released and passes a predetermined point in the forward direction generally away from the butt portion 15 of the stock member 14, the first and second cams 38, 39 may provide a mechanical advantage that serves to enhance the force with which the arrow is propelled from the crossbow 1. Although a particular cam assembly having a particular cam is shown, any type of cam assembly and/or cam, chosen with sound judgment by a person of ordinary skill in the art, may be used.

With continued reference now to FIG. 1, the first and second barrel cables 41, 42 may extend between the second ends 36*b*, 37*b* of the first and second limbs 36, 37. The first barrel cable 41 may comprise first and second ends 41*a*, 41*b* that are operatively connected to the second end 36*b* of the first limb 36. In one embodiment, the first and second ends 41*a*, 41*b* may be operatively connected to the axle 43. The first barrel cable 41 may be received by the second cam 39 such that the rotation of the second cam 39 in the first direction causes the first barrel cable 41 to travel over the second cam 39. The second barrel cable 42 may comprise first and second ends 42*a*, 42*b* that are operatively connected to the second end 37*b* of the second limb 37. The second barrel cable 42 may be received by the first cam 38 such that the rotation of the first cam 38 in the first direction causes the second barrel cable 42 to travel over the first cam 38. The traveling of the first and second barrel cables 41, 42 across the first and second cams 38, 39, respectively, decreases the effective length of the first and second barrel cables 41, 42 thereby causing the first and second limbs 36, 37 to be flexed or pulled inward generally towards the main beam 12 thereby enhancing the force with which the arrow 2 is propelled from the crossbow 1 by causing the amount of potential energy stored in the first and second limbs 36, 37 to be increased. The first and second barrel cables 41, 42 may pass through a cable slot, not shown, formed in the barrel member 16. The drawing and releasing of the bowstring 34 may cause the first and second limbs 36, 37 to be flexed or pulled generally inward toward the main beam 12 as the bowstring 34 is drawn and then moved away from the main beam 12 as the bowstring 34 is released as is well known in the art.

With continued reference now to FIG. 1, the trigger mechanism 20 may be operatively connected to the main beam 12. The trigger mechanism 20 may be a mechanism that is suitable for selectively retaining and releasing the bowstring 34 as is well known in the art. Generally, when an associated operator draws the bowstring 34, the bowstring 34 may be received and selectively retained by a string latch, not shown, of the trigger mechanism 20. Once the crossbow string 34 has been drawn back, an associated operator may place the arrow 2, or other suitable projectile, onto the upper surface 17 of the stock member 16 such that the nock of the arrow 2 engages the bowstring 34. To discharge or fire the projectile from the crossbow 1, a trigger lever 21 of the trigger mechanism 20 may be actuated or pulled rearward to cause the trigger mechanism 20 to release the bowstring 34 thereby releasing the energy stored in the limbs 36, 37 of the bow assembly 30 and propelling the arrow 2 forward from the crossbow.

Figure 2:
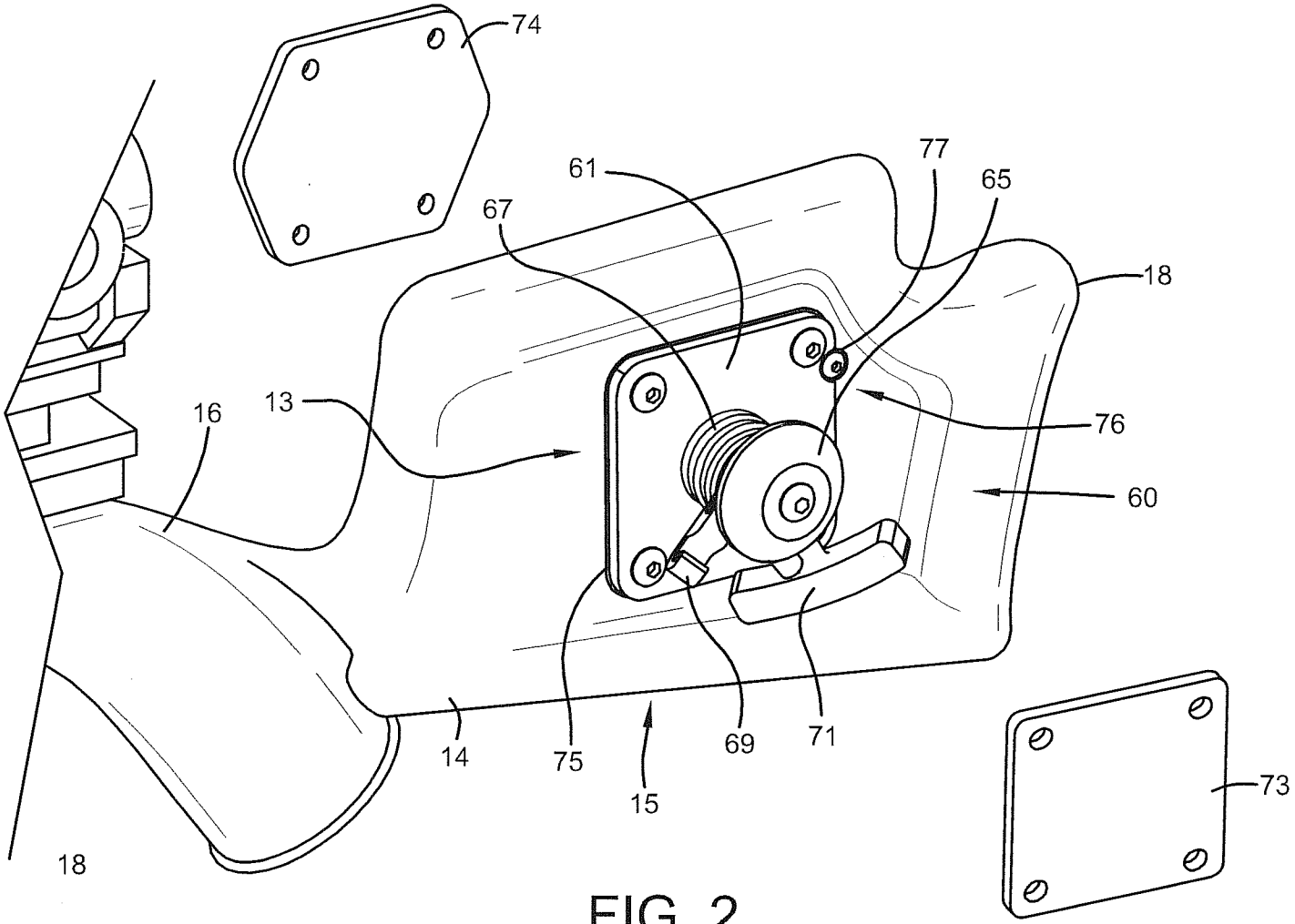
FIG. 2 shows a partial view of a crossbow showing a stock member having an integrated cocking device installed therein according to one embodiment of the invention.
Figure 4:
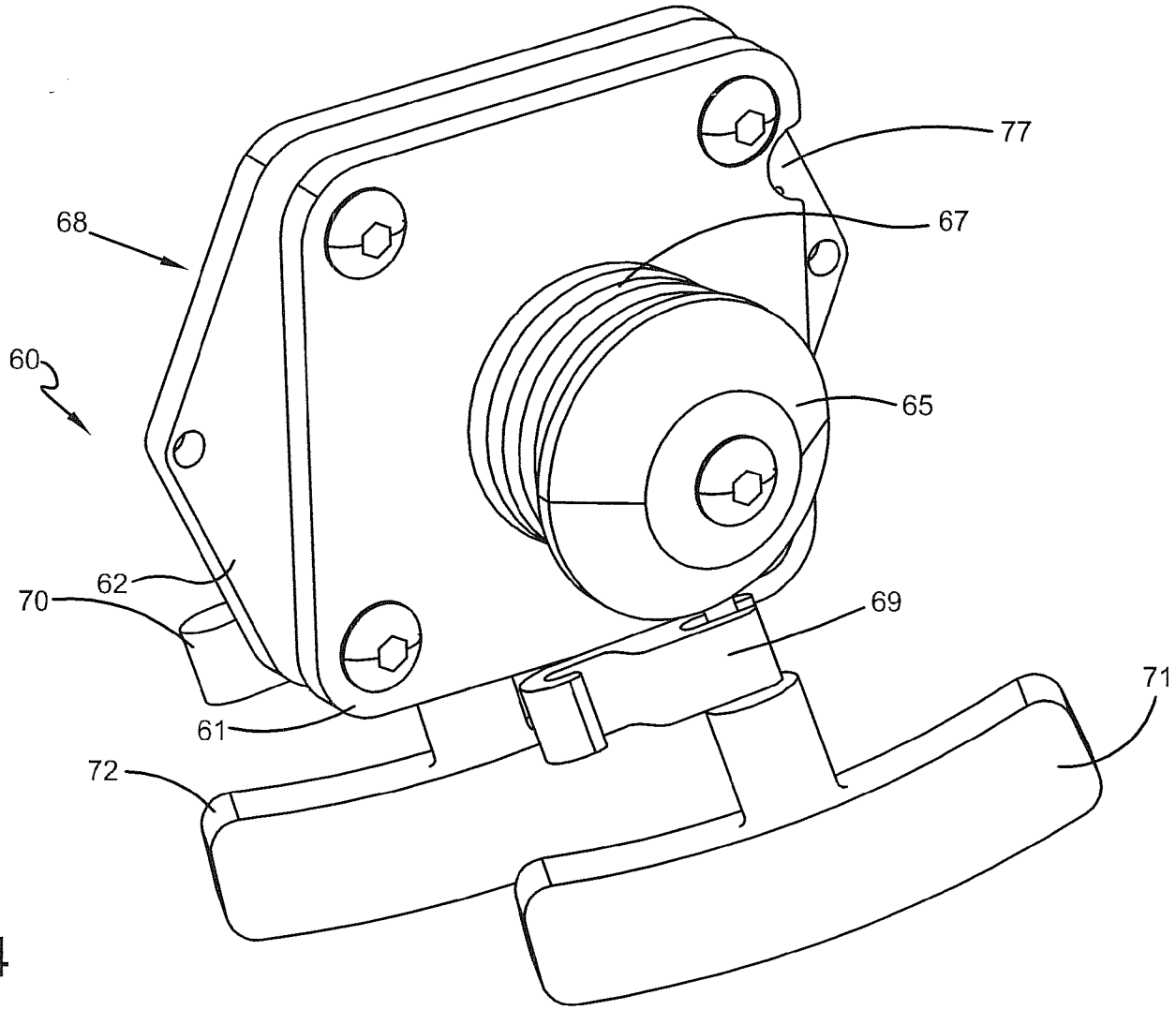
FIG. 4 shows an angled, side, perspective view of an integrated cocking device according to one embodiment of the invention.
Figure 5:
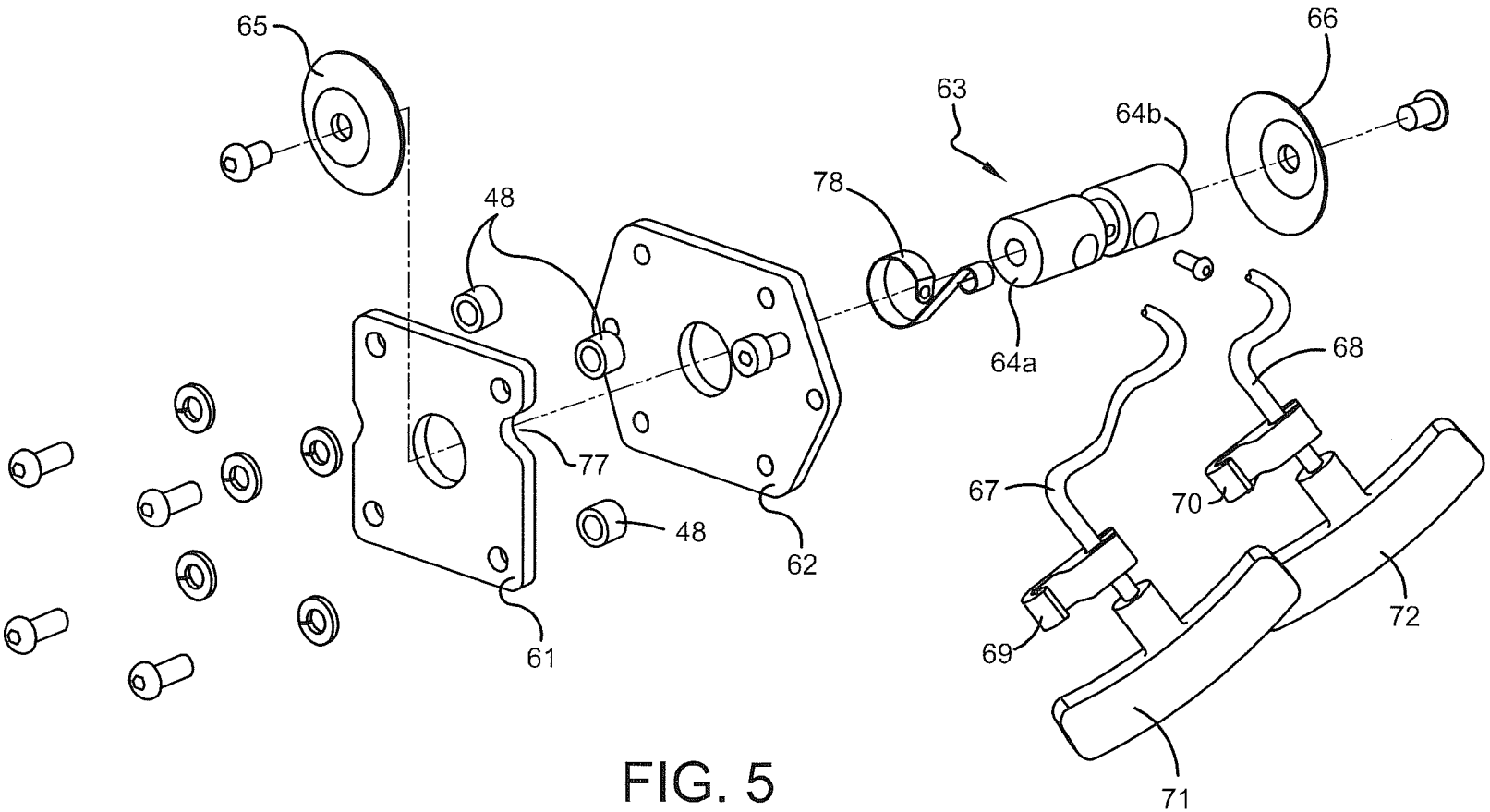
FIG. 5 shows an assembly view of an integrated cocking device according to one embodiment of the invention.
Figure 6:
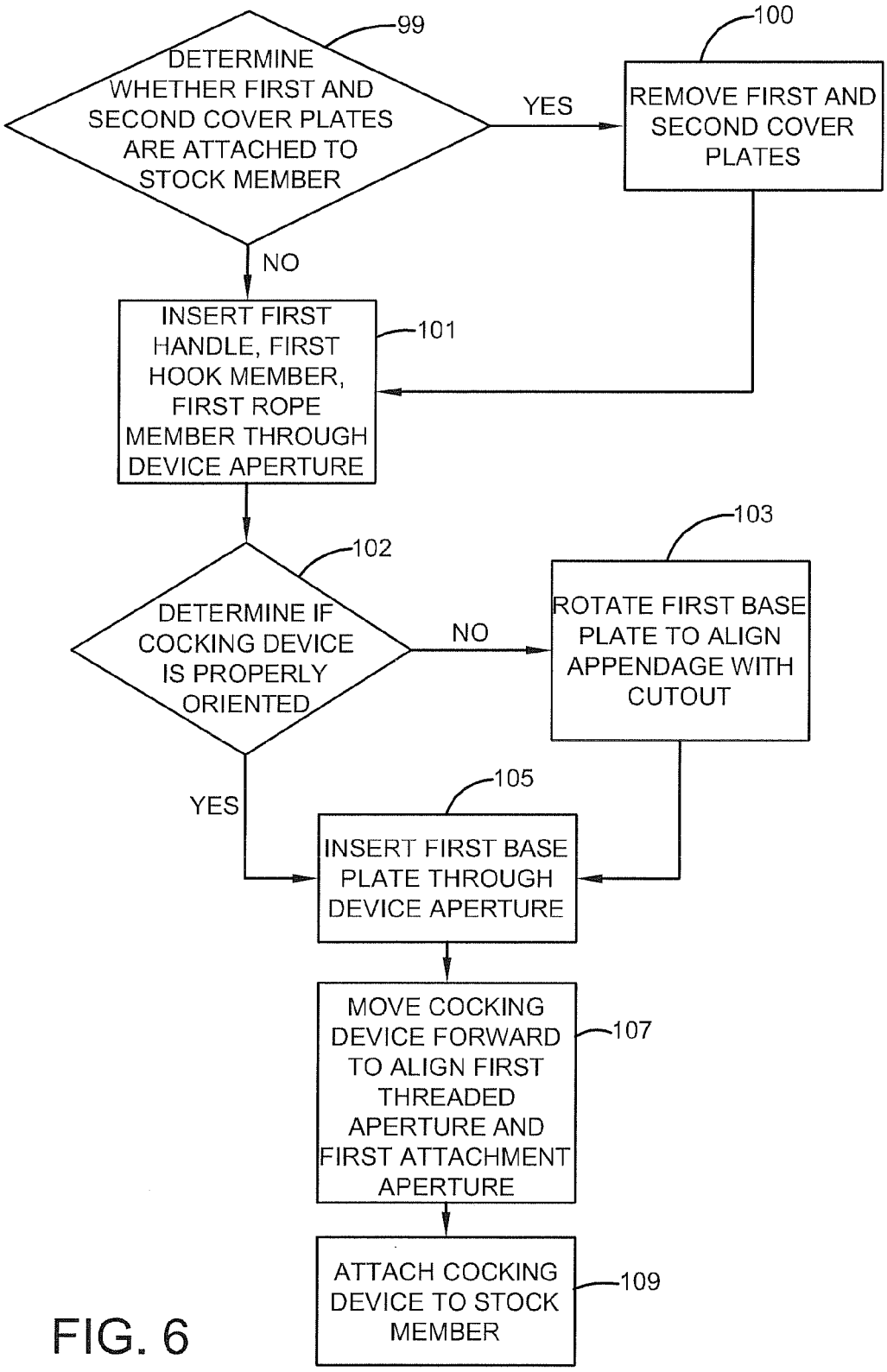
FIG. 6 shows a flow chart for a method of installing an integrated cocking device according to one embodiment of the invention.

With reference now to FIGS. 2, 4, and 5, the stock member 14 may be adapted to receive the integrated cocking device 60. The cocking device 60 may be adapted to be removably installed into stock member 14 of the crossbow 1. The integrated cocking device 60 may comprise first and second base plates 61, 62. The first base plate 61 may be operatively connected to the second base plate 62 and positioned relative to each other such that the first and second base plates 61, 62 are positioned on to opposite sides of the stock member 14 (i.e., the first base plate 61 positioned adjacent to a first side of the stock member 14 and the second base plate 62 positioned adjacent to a second side of the stock member 14) when installed on the crossbow 1. In one embodiment, the first base plate 61 may be connected to the second base plate 62 utilizing a plurality of conventional fasteners. In a more specific embodiment, the first base plate 61 may be connected to the second base plate 62 utilizing a plurality of screws, each screw having a plurality of threads formed thereon and inserted through an opening formed in the first base plate 61 and be threadably received in a corresponding opening formed in the second base plate 62. A spacer 48 may be positioned substantially around each of the openings formed in the first and second base plates 61, 62 to extend therebetween. Each of the spacers 48 may comprise a rigid, substantially cylindrical structure having an axial cavity suitable for receiving the screw or other conventional fastener through the spacer 48 to connect the first and second base plates 61, 62.

With reference now to FIGS. 1, 2, 4, and 5, a shaft member 63 may be rotatably received through the first and second base plates 61, 62. The shaft member 63 may comprise a first side plate 65 and a second side plate 66. The first side plate 65 may be juxtaposed and affixed to a first end 64*a* of the shaft member 63 and the second side plate 66 may be juxtaposed and affixed to the second end 64*b* of the shaft member 63. The first and second side plates 65, 66 may be attached to the first and second ends 64*a*, 64*b* of the shaft member 63 such that the rotation of the shaft member 63 causes the corresponding rotation of the first and second side plates 65, 66. The shaft member 63 may be positioned substantially perpendicular to the longitudinal axis of the main beam 12 such that installing the cocking device 60 to the crossbow 1 as described herein causes the first and second ends 64*a*, 64*b* to extend substantially the same distance from opposing sides of the stock member 14. In one embodiment, the shaft member 63 may comprise an elongated, cylindrical structure rotatably received through the first and second base plates 61, 62 such that the first end 64*a* extends away from the first base plate 61 and the second end 64*b* extends away from the second base plate 62. In another embodiment, the shaft member 63 may comprise a pair of independent shaft members such that one of the independent shaft members is rotatably attached to the first base plate 61 and the other independent shaft member is rotatably attached to the second base plate 62.

With reference now to FIGS. 2, 4, and 5, a first rope member 67 may be operatively connected to the shaft member 63 between the first side plate 65 and the first base plate 61. A second rope member 68 may be operatively connected to the shaft member 63 between the second side plate 66 and the second base plate 62. The first and second rope members 67, 68 may be operatively connected to the shaft member 63 such that the rotation of the shaft member 63 causes a change in the effective length of the first and second rope members 67, 68. In one embodiment, the rotation of the shaft member 63 may cause the first and second rope members 67, 68 to be wrapped or wound around the shaft member 63. As the first and second rope members 67, 68 are wound around the shaft member 63, the first and second side plates 65, 66 may act as a barrier or stop to at least partially cause the first and second rope members 67, 68 to be retained around the shaft member 63.

With continued reference now to FIGS. 2, 4, and 5, a first hook member 69 may be operatively connected to the first rope member 67 and a second hook member 70 may be operatively connected to the second rope member 68. The first and second hook members 69, 70 may be adapted to be selectively engaged with the bowstring 34 and to retain the bowstring 34 as the bowstring 34 is being drawn during operation of the cocking device 60. In this manner, when the first and second hook members 69, 70 are placed on the bowstring 34 and retracted, the bowstring 34 will be drawn rearward generally towards the butt portion 15 of the stock member 16 until the bowstring 34 is received by the trigger mechanism 20. During operation of the cocking device 60, as the bowstring 34 is being drawn rearward, the first and second rope members 67, 68 are wrapped or wound around the shaft member 63. In one embodiment, the shaft member 63 may comprise a biasing member 78. The biasing member 78 may be operatively connected to the shaft member 63 such that the biasing member 78 urges the shaft member 63 to rotate in a first direction thereby causing the automatic retraction of the first and second rope members 67, 68. In a more specific embodiment, the biasing member 78 may be positioned between the first and second base plates 61, 62. In one embodiment, a first and second limiting pin, not shown, may be attached to the first and second base plates 61, 62, respectively. The first and second limiting pins, not shown, may be positioned to restrict the movement of the first and second rope members 67, 68 during retraction and extension from the shaft member 63.

With continued reference now to FIGS. 2, 4, and 5, in one embodiment, a first handle 71 and a second handle 72 may be utilized to draw the bowstring 34 rearward. The first and second handles 71, 72 may be operatively connected to the first and second rope members 67, 68, respectively. In one embodiment, the first and second handles 71, 72 may be integrally formed with the first and second hook members 69, 70. The first and second handles 71, 72 may be shaped to be grasped by an associated user and subsequently apply a generally rearward force to overcome the force of the bowstring 34 thereby retracting or drawing the bowstring 34. Upon the bowstring 34 being received by the trigger mechanism 20, the first and second hook members 69, 70 can be disengaged from the bowstring 34 thereby allowing the arrow 2 to be appropriately positioned on the upper surface 17 of the barrel member 16 and engaged with the bowstring 34. The engagement of the bowstring 34 by the first and second hook members 69, 70 may provide a force substantial enough to prevent the biasing member 78 from causing the rotation of the shaft member 63. Subsequently, the disengagement of the first and second hook members 69, 70 from the bowstring 34 may remove the force provided by the bowstring 34 such that the biasing member 78 causes the rotation of the shaft member 63 to automatically retract the first and second rope members 67, 68.

Figure 3:
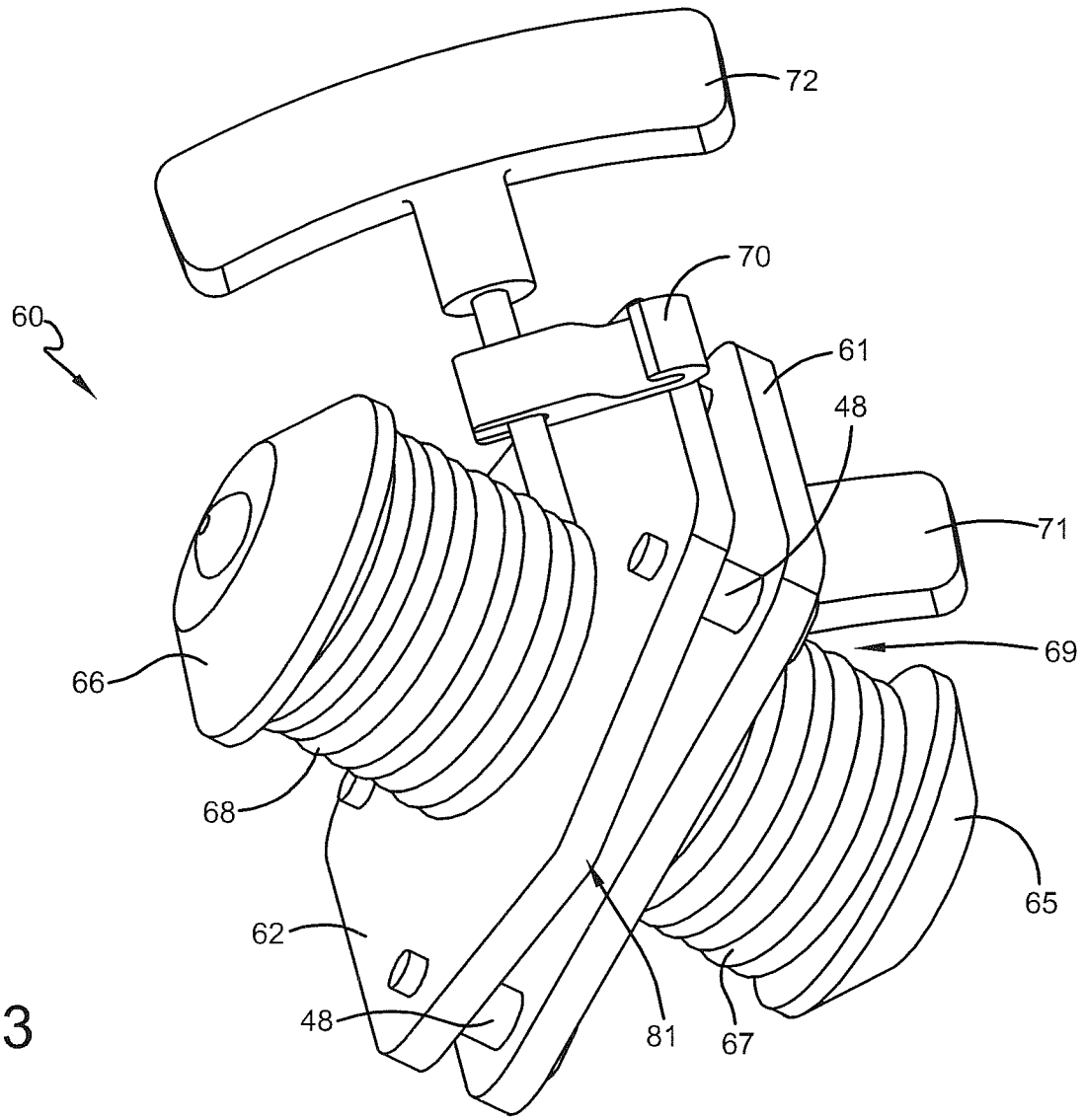
FIG. 3 shows an angled, rearward, perspective view of an integrated cocking device according to one embodiment of the invention.

With reference now to FIGS. 1, 3, and 5, a perimeter 13 may define a device aperture 75 formed through the stock member 16. In one embodiment, the device aperture 75 may be positioned adjacent to the butt portion 15. The device aperture 75 may be shaped and designed to receive and retain the cocking device 60 at least partially within the stock member 14. The device aperture 75 may be designed to limit manner in which the cocking device 60 can be inserted into the device aperture 75 to help ensure that the cocking device 60 is properly installed on the crossbow 1. In one embodiment, the first base plate 61 may comprise a distinct shape from the second base plate 62 and the device aperture 75 may be shaped to require the cocking device 60 to be inserted from a single direction. Additionally, the first base plate 61 may comprise a distinct shape from the second base plate 62 and the device aperture 75 may be shaped to receive only, for example, the first base plate 61 while preventing, for example, the second base plate 62 from passing there through. In one embodiment, the second base plate 62 may comprise a shape that prevents the second base plate 62 from passing through the device aperture 75. In a more specific embodiment, the second base plate 62 may comprise at least a first side portion 81 that extends to contact the stock member 14 when the cocking device 60 is positioned to extend through the device aperture 75 thereby preventing the second base plate 62 from being inserted into or passing through the device aperture 75. In a more specific embodiment, the second base plate 62 may comprise first and second side portions 81 that extend from opposing sides of the second base plate 62 substantially along the longitudinal axis of the main beam 12.

With reference now to FIGS. 3 and 5, the device aperture 75 may be shaped to require that the first base plate 61 be oriented correctly thereby preventing the first base plate 61 from passing through the device aperture 75 if inserted incorrectly (i.e., upside down). In one embodiment, the first base plate 61 may comprise an appendage 76 that extends away from or is adjacent to the edge or side of the first base plate 61. In a more specific embodiment, the appendage 76 may be formed by a fastening device, such as, for example, a screw, attached to the back side of the second base plate 62 and/or utilized to operatively connect the first and second base plates 61, 62. The device aperture 75 may comprise a cutout 77 formed in the perimeter 13 defining the device aperture 75 that corresponds to the appendage 76 when the cocking device 60 is properly oriented. The appendage 76 may be of a suitable size and shape to prevent the first base plate 61 from passing through the device aperture 75 if the cocking device 60 is not properly oriented. The appendage 76 may at least partially ensure the proper orientation of the cocking device 60 by requiring the first base plate 61 to be oriented in a specific direction that allows the appendage 76 to pass through the cutout 77 as the first base plate 61 is inserted or passed through the device aperture 75.

With reference now to FIGS. 1-6, a method for installing the cocking device 60 will be described. In one embodiment, the cocking device 60 may include first and second cover plates 73, 74. The first and second cover plates 73, 74 may be designed to be attached to the stock member 16 in place of the cocking device 60 (i.e., when the cocking device 60 is not installed on the stock member 16). The first and second cover plates 73, 74 may comprise a rigid outer shell that can be selectively attached to the stock member 16 to substantially cover the device aperture 75 when the cocking device 60 is not installed on the crossbow 1. In one embodiment, the first and second cover plates 73, 74 may comprise a molded plastic. The first and second cover plates 73, 74 may comprise any composition chosen with sound judgment by a person of ordinary skill in the art. Initially, the first and second cover plates 73, 74 may be attached to the stock member 14 utilizing conventional fasteners. In one embodiment the first and second cover plates 73, 74 may comprise corresponding cover apertures, not shown, suitable for receiving a conventional fastener. The cover apertures, not shown, may align with at least a first attachment aperture 80 formed through the stock member 14 such that the first attachment aperture 80 allows the conventional fastener to be inserted through the corresponding cover apertures, not shown, to attach the first and second cover plates 73, 74 to the stock member 14.

With reference now to FIGS. 2-6, initially, the user may determine if the first and second cover plates 73, 74 are attached to the stock member 14, step 99. If attached, prior to installing the cocking device 60, the first and second cover plates 73, 74 may be removed from the stock member 14, step 100. The removal of the first and second cover plates 73, 74 may uncover or expose the device aperture 75 thereby allowing the first handle 71, the first hook member 69, and the first rope member 67 to be inserted into or passed through the device aperture 75, step 101. Next, the user may determine if the cocking device is properly oriented, step 102. In one embodiment, the user may determine if the cocking device 60 is properly oriented by determining if the appendage 76 is positioned to pass through the cutout 77 as the first base plate 61 is inserted into the device aperture 75. If not properly oriented, the first base plate 61, and therefore the cocking device 60, may be rotated to properly orient the cocking device 60, step 103. The first base plate 61, and therefore the cocking device 60, may be properly oriented when rotated such that the cutout 77 formed in the perimeter of the device aperture 75 is substantially aligned with the appendage 76 such that the appendage 76 is able to pass through the cutout 77 as the first base plate 61 is inserted into or passed through the device aperture 75. The first base plate 61 may then be inserted into or passed through the device aperture 75, step 105. Passing the first base plate 61 through the device aperture 75 may cause the second base plate 62 to abut the side surface of the stock member 14. In one embodiment, the at least a first side portion 81 may abut the side surface of the stock member 14 and may prevent the second base plate 62 from being inserted into or passing through the device aperture 75. In a more specific embodiment, the first and second side portions 81 may abut the side surface of the stock member 14. The cocking device 60 may be moved or slid forward, generally towards the first end 4 of the main beam 12 such that at least a first threaded aperture 79 formed in the second base plate 62 is substantially aligned with at least the first attachment aperture 80 formed through the stock member 14, step 107. In one embodiment, the at least a first threaded aperture 79 may be formed through the first side portion 81 of the second base plate 62. In a more specific embodiment, sliding the cocking device 60 forward may cause the first threaded aperture 79 to be substantially aligned with the first attachment aperture 80 and may cause a second threaded aperture 82 formed through the stock member 14 on an opposing side of the device aperture 75 from the first threaded aperture 79 to be substantially aligned with a second attachment aperture 83 formed in the second side portion 81. The cocking device 60 may then be attached to the stock member 14, step 109. In one embodiment, the first attachment aperture 80 may comprise a shape and design suitable for receiving a conventional fastener, such as, for example, a screw, suitable for attaching the cocking device 60 to the stock member 14 as is well known in the art. The conventional fastener may be inserted through the first attachment aperture 80 and may comprise a plurality of threads that correspond to the plurality of threads of the threaded aperture 79. The conventional fastener may then be rotated such that the corresponding threads engage to attach the cocking device 60 to the stock member 14. To cocking device 60 may be removed or uninstalled from the crossbow 1 by performing the steps for installing the cocking device 60, described above, in the reverse order.

The embodiments have been described, hereinabove. It will be apparent to those skilled in the art that the above methods and apparatuses may incorporate changes and modifications without departing from the general scope of this invention. It is intended to include all such modifications and alterations in so far as they come within the scope of the appended claims or the equivalents thereof.

Having thus described the invention, it is now claimed:

1. A crossbow comprising:

a main beam comprising: 1) a stock member having: (a) a first side; (b) a second side; and, (c) an aperture that extends through the first and second sides of the stock member; and, 2) a barrel member that comprises an upper surface having a channel that receives at least a portion of an associated arrow placed on the upper surface to be propelled from the crossbow;

a trigger mechanism supported to the main beam;

a bow assembly supported to the main beam and comprising: 1) a bow portion comprising first and second bow limbs; and, 2) a bowstring that extends between the first and second bow limbs;

a cocking device comprising: 1) a shaft having first and second ends; 2) a first rope operatively connected to the first end of the shaft; 3) a first hook operatively connected to the first rope; 4) a first handle operatively connected to the first rope; 5) a second rope operatively connected to the second end of the shaft; 6) a second hook operatively connected to the second rope; 7) a second handle operatively connected to the second rope; 8) a first baseplate that: (a) has a shaft opening that receives the shaft; and, (b) is sized and shaped such that it can pass through the aperture in the stock member; and, 9) a second baseplate that: (a) has a shaft opening that receives the shaft; (b) is sized and shaped such that it cannot pass through the aperture in the stock member; and, (c) is affixed to the second side of the stock member;

wherein when the cocking device is mounted to the stock member: 1) a connector connects the first baseplate to the second baseplate; and, 2) the cocking device is operable by the associated user by: (a) engaging the bowstring with the first and second hooks; and, (b) pulling the first and second handles to draw the bowstring into a position where it is retained by the trigger mechanism; and, wherein the trigger mechanism is operable by the associated user to release the associated arrow from the retained position so that the associated arrow is propelled by the bowstring away from the crossbow.

2. The crossbow of claim 1 wherein the first baseplate is sized and shaped such that it can only pass through the aperture in the stock member when it is in a specific predetermined orientation with respect to the aperture.

3. The crossbow of claim 2 wherein:

the aperture comprises a cutout formed on a perimeter of the aperture;

an appendage extends from a side of the first base plate; and, the appendage must be received in the cutout for the first baseplate to pass through the aperture.

4. The crossbow of claim 1 wherein when the cocking device is mounted to the stock member:

at least one spacer having a cavity is positioned between the first and second baseplates; and, the connector passes through a connector opening in the first baseplate, the cavity in the spacer, and a connector opening in the second baseplate.

5. The crossbow of claim 1 wherein:

the first rope comprises: 1) a first end attached to the first end of the shaft; and, 2) a second end to which the first hook and first handle are attached;

the second rope comprises: 1) a first end attached to the second end of the shaft; and, 2) a second end to which the second hook and second handle are attached; and, the first and second ropes wrap around the first and second ends of the shaft, respectively, as the associated user pulls the first and second handles to draw the bowstring into the position where it is retained by the trigger mechanism.

6. The crossbow of claim 1 wherein:

the first rope comprises: 1) a first end attached to the first end of the shaft; and, 2) a second end to which the first hook and first handle are attached;

the second rope comprises: 1) a first end attached to the second end of the shaft; and, 2) a second end to which the second hook and second handle are attached; and, a biasing member urges the shaft to rotate to wrap the first and second ropes around the first and second ends of the shaft, respectively.

7. The crossbow of claim 1 wherein:

the first rope: 1) has a first end attached to the first end of the shaft; 2) has a second end to which the first hook and first handle are attached; and, 3) is wrapable around the first end of the shaft;

the second rope: 1) has a first end attached to the second end of the shaft; 2) has a second end to which the second hook and second handle are attached; and, 3) is wrapable around the second end of the shaft;

a first side plate: 1) is attached to the first end of the shaft; and, 2) acts as a stop to retain the first rope on the first end of the shaft when the first rope is wrapped around the first end of the shaft; and, a second side plate: 1) is attached to the second end of the shaft; and, 2) acts as a stop to retain the second rope on the second end of the shaft when the second rope is wrapped around the second end of the shaft.

8. The crossbow of claim 1 wherein:

a first side portion extends from a first side of the second baseplate;

a second side portion extends from a second side, opposite the first side, of the second baseplate; and, the first and second side portions prevent the second baseplate from passing through the aperture in the stock member.

9. The crossbow of claim 1 wherein:

the cocking device is removable by the associated user from the stock member;

a first cover plate is attached to the first side of the stock member when the cocking device is removed;

a second cover plate is attached to the second side of the stock member when the cocking device is removed; and, the first and second cover plates cover the aperture when they are attached to the stock member.

10. The crossbow of claim 1 wherein:

the stock member comprises a butt portion adapted to be placed against the shoulder of the associated user when the associated arrow is propelled by the bowstring away from the crossbow; and, the aperture is formed in the butt portion of the stock member.

11. A crossbow comprising:

a main beam comprising: 1) a stock member having: (a) a first side; (b) a second side; and, (c) an aperture that extends through the first and second sides of the stock member; and, 2) a barrel member that comprises an upper surface having a channel that receives at least a portion of an associated arrow placed on the upper surface to be propelled from the crossbow;

a trigger mechanism supported to the main beam;

a bow assembly supported to the main beam and comprising: 1) a bow portion comprising first and second bow limbs; and, 2) a bowstring that extends between the first and second bow limbs;

a cocking device comprising: 1) a shaft having first and second ends; 2) a first rope having a first end attached to the first end of the shaft and a second end; 3) a first hook connected to the second end of the first rope; 4) a first handle connected to the second end of the first rope; 5) a second rope having a first end attached to the second end of the shaft and a second end; 6) a second hook connected to the second end of the second rope; 7) a second handle connected to the second end of the second rope; 8) a first baseplate that: (a) has a shaft opening that receives the shaft; and, (b) is sized and shaped such that it can pass through the aperture in the stock member; 9) a biasing member urges the shaft to rotate to wrap the first and second ropes around the first and second ends of the shaft, respectively; and, 10) a second baseplate that: (a) has a shaft opening that receives the shaft; (b) is sized and shaped such that it cannot pass through the aperture in the stock member; (c) has a first side portion that extends from a first side of the second baseplate, wherein the first side portion prevents the second baseplate from passing through the aperture in the stock member; and; (d) is affixed to the second side of the stock member;

wherein when the cocking device is mounted to the stock member: 1) a connector connects the first baseplate to the second baseplate; and, 2) the cocking device is operable by the associated user by: (a) engaging the bowstring with the first and second hooks; and, (b) pulling the first and second handles to draw the bowstring into a position where it is retained by the trigger mechanism; and, wherein the trigger mechanism is operable by the associated user to release the associated arrow from the retained position so that the associated arrow is propelled by the bowstring away from the crossbow.

12. The crossbow of claim 11 wherein the first baseplate is sized and shaped such that it can only pass through the aperture in the stock member when it is in a specific predetermined orientation with respect to the aperture.

13. The crossbow of claim 12 wherein:

the aperture comprises a cutout formed on a perimeter of the aperture;

an appendage extends from a side of the first base plate; and, the appendage must be received in the cutout for the first baseplate to pass through the aperture.

14. The crossbow of claim 11 wherein:

a second side portion extends from a second side, opposite the first side, of the second baseplate; and, the second side portion prevents the second baseplate from passing through the aperture in the stock member.

15. The crossbow of claim 11 wherein when the cocking device is mounted to the stock member:

at least one spacer having a cavity is positioned between the first and second baseplates; and, the connector passes through a connector opening in the first baseplate, the cavity in the spacer, and a connector opening in the second baseplate.

16. The crossbow of claim 11 wherein:

the first and second ropes wrap around the first and second ends of the shaft, respectively, as the associated user pulls the first and second handles to draw the bowstring into the position where it is retained by the trigger mechanism.

17. The crossbow of claim 11 further comprising:

a first side plate that: 1) is attached to the first end of the shaft; and, 2) acts as a stop to retain the first rope on the first end of the shaft when the first rope is wrapped around the first end of the shaft; and, a second side plate that: 1) is attached to the second end of the shaft; and, 2) acts as a stop to retain the second rope on the second end of the shaft when the second rope is wrapped around the second end of the shaft.

18. The crossbow of claim 11 wherein:

the stock member comprises a butt portion adapted to be placed against the shoulder of the associated user when the associated arrow is propelled by the bowstring away from the crossbow; and, the aperture is formed in the butt portion of the stock member.

19. The crossbow of claim 11 wherein:

the first hook is integrally formed with the first handle; and, the second hook is integrally formed with the second handle.

20. The crossbow of claim 11 wherein:

the cocking device is removable by the associated user from the stock member;

a first cover plate is attached to the first side of the stock member when the cocking device is removed;

a second cover plate is attached to the second side of the stock member when the cocking device is removed; and, the first and second cover plates cover the aperture when they are attached to the stock member.

21. The crossbow of claim 1 wherein:

the first hook is integrally formed with the first handle; and, the second hook is integrally formed with the second handle.

* * * * *